US009237604B2

(12) United States Patent
Chang

(10) Patent No.: US 9,237,604 B2
(45) Date of Patent: Jan. 12, 2016

(54) HEATING CABLE CONTROL SYSTEM

(71) Applicant: Long-Huang Chang, New Taipei (TW)

(72) Inventor: Long-Huang Chang, New Taipei (TW)

( * ) Notice: Subject to any disclaimer, the term of this patent is extended or adjusted under 35 U.S.C. 154(b) by 147 days.

(21) Appl. No.: 14/147,589

(22) Filed: Jan. 6, 2014

(65) Prior Publication Data

US 2015/0195869 A1 Jul. 9, 2015

(51) Int. Cl.
*H05B 1/02* (2006.01)
*H05B 3/56* (2006.01)

(52) U.S. Cl.
CPC ..... *H05B 1/0288* (2013.01); *H05B 3/56* (2013.01)

(58) Field of Classification Search
CPC ..... H05B 3/12; H05B 3/14; H05B 3/141; H05B 1/0288; H05B 3/56
USPC ..... 219/212, 504, 481, 497
See application file for complete search history.

(56) References Cited

U.S. PATENT DOCUMENTS 4,661,690 A * 4/1987 Yamamoto ..... H05B 3/56 219/505
5,428,206 A * 6/1995 Uchida ..... G05D 23/4201 219/483
5,665,261 A * 9/1997 Damsohn ..... B60H 1/2225 219/202
6,426,488 B2 * 7/2002 Schielke ..... A47C 21/048 219/494
2005/0109752 A1 * 5/2005 Merk ..... H05B 1/0272 219/212

* cited by examiner

*Primary Examiner* — Mark Paschall
(74) *Attorney, Agent, or Firm* — Leong C. Lei

(57) ABSTRACT

The present invention provides a heating cable control system. The system is configured with an optical coupling circuit, a NTC break-off detection circuit, and a fourth comparator circuit. The optical coupling circuit has an input terminal, a first control terminal, and a second control terminal. The first and second control terminals are electrically connected to first terminals of a NTC resistive layer and a PTC resistive wire of the heating cable, respectively. A second terminal of the PTC detection circuit is electrically connected to a silicon-controlled switch circuit. A second terminal of the NTC resistive layer is electrically connected to a negative input terminal of the fourth comparator circuit through the NTC break-off detection circuit, and is compared against a third reference voltage circuit. As such, when the NTC resistive layer becomes open-circuited, the heating to the PTC resistive wire is stopped reliably, thereby enhancing usage safety.

1 Claim, 7 Drawing Sheets

HEATING CABLE CONTROL SYSTEM

BACKGROUND OF THE INVENTION (a) Technical Field of the Invention

The present invention is generally related to heating devices, and more particular to a heating cable control system having an optical coupling circuit, a NTC break-off detection circuit, and a fourth comparator circuit.

(b) Description of the Prior Art

As shown in FIG. 1, U.S. Pat. No. 8,164,035, titled Heating Device Having Dual-core Heating Cable, teaches a dual-core heating cable control system containing a dual-core heating cable 30 and a control device 20. The control device 20 contains a control circuit 6, a DC voltage circuit 22, a first comparator circuit 40, a second comparator circuit 41, a synchronous signal input circuit 23, a first reference voltage circuit 24, an adjustment circuit 27, a NTC (negative temperature coefficient) detection circuit 75, a PTC (positive temperature coefficient) detection circuit 72, a switch circuit, a load detection circuit 28, a protection circuit, a function selection circuit 29, and a status indicator circuit 74. The DC voltage circuit 22 provides DC voltage $V_{cc}$ to power the control device 20 and, through the switch circuit, to activate the gate of a second silicon-controlled regulator so that the second silicon-controlled regulator conducts its anode and cathode, and that the AC is conducted to a PTC resistive wire of the dual-core heating cable to heat up. The PTC detection circuit obtains a load current through the PTC resistive wire and converts the load current to a voltage compared to the first reference voltage through the second comparator circuit. When a high level is detected, the heating up to the dual-core heating cable continues whereas a low level is detected, the heating up to the dual-core heating cable stops, thereby achieving constant temperature. Additionally, the dual-core heating cable is configured with a NTC resistive layer and electrical current flows through the PTC resistive wire, the NTC resistive layer, and then to the NTC detection circuit. The NTC detection circuit coverts the current to a voltage compared against the first reference voltage through the first comparator circuit. When a high level is detected, the heating up to the PTC resistive wire continues whereas a low level is detected, the heating up to the PTC resistive wire stops, thereby achieving a second over-temperature protection.

However, even though with the constant temperature and the second over-temperature protection, the heating cable control system still suffers the following disadvantage. When the NTC detection circuit stops heating up due to the second silicon-controlled regulator becomes open-circuited. The protection circuit could still trigger a first silicon-controlled regulator to conduct and the PTC resistive wire is still heated up. The NTC detection circuit then cannot accurately detect the breaking off of the NTC resistive layer and top the heating up to the PTC resistive wire. The dual-core heating cable then would be over-heated and damaged, or the user could be burned.

SUMMARY OF THE INVENTION

Therefore, the present invention provides a heating cable control system to obviate the foregoing shortcoming. The system is configured with an optical coupling circuit, a NTC break-off detection circuit, and a fourth comparator circuit. The optical coupling circuit has an input terminal, a first control terminal, and a second control terminal. The first and second control terminals are electrically connected to first terminals of a NTC resistive layer and a PTC resistive wire of the heating cable, respectively. A second terminal of the PTC detection circuit is electrically connected to a silicon-controlled switch circuit. A second terminal of the NTC resistive layer is electrically connected to a negative input terminal of the fourth comparator circuit through the NTC break-off detection circuit, and is compared against a third reference voltage circuit. As such, when the NTC resistive layer becomes open-circuited, the heating to the PTC resistive wire is stopped reliably, thereby enhancing usage safety.

The heating cable control system contains an AC source, a control device, and a dual-core heating cable.

The AC source has a first terminal and a second terminal. The first terminal is connected to ground.

The control device contains a fuse, a DC voltage circuit, a synchronous signal input circuit, a first reference voltage circuit, a control circuit, a NTC detection circuit, an adjustment circuit, a load detection circuit, a silicon controlled switch circuit, a silicon controlled short-circuit detection circuit, a function selection circuit, a PTC detection circuit, a second reference voltage circuit, a NTC break-off detection circuit, a third reference voltage circuit, a status indicator circuit, an optical coupling circuit, a first comparator circuit, a second comparator circuit, a third comparator circuit, and a fourth comparator circuit. The control circuit contains a microchip.

The dual-core heating cable contains the NTC resistive layer and the PTC resistive wire inside. The PTC resistive wire has a first terminal and a second terminal, and the NTC resistive layer has a first terminal and a second terminal. The first terminals of the PTC resistive wire and the NTC resistive layer are electrically connected to the first and second control terminals of the optical coupling circuit, respectively; The second terminals of the PTC resistive wire and the NTC resistive layer are electrically connected to the load detection circuit's another terminal and a terminal of the NTC break-off detection circuit, respectively.

The optical coupling circuit has an input terminal, a first control terminal, and a second control terminal. The first and second control terminals are electrically connected to first terminals of the NTC resistive layer and the PTC resistive wire, respectively. The second terminal of the PTC detection circuit is electrically connected to the silicon-controlled switch circuit. The second terminal of the NTC resistive layer is electrically connected to a negative input terminal of the fourth comparator circuit through the NTC break-off detection circuit, and is compared against the third reference voltage circuit. As such, when the NTC resistive layer becomes open-circuited, the heating to the PTC resistive wire is stopped reliably, thereby enhancing usage safety.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3-1 is a partially enlarged schematic circuit diagram showing a control circuit of the dual-core heating cable control system of the present invention.

FIG. 4-1 is a schematic diagram showing the calculation of the voltage between the NTC resistive layer and the PTC resistive wire of the dual-core heating cable control system of the present invention.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
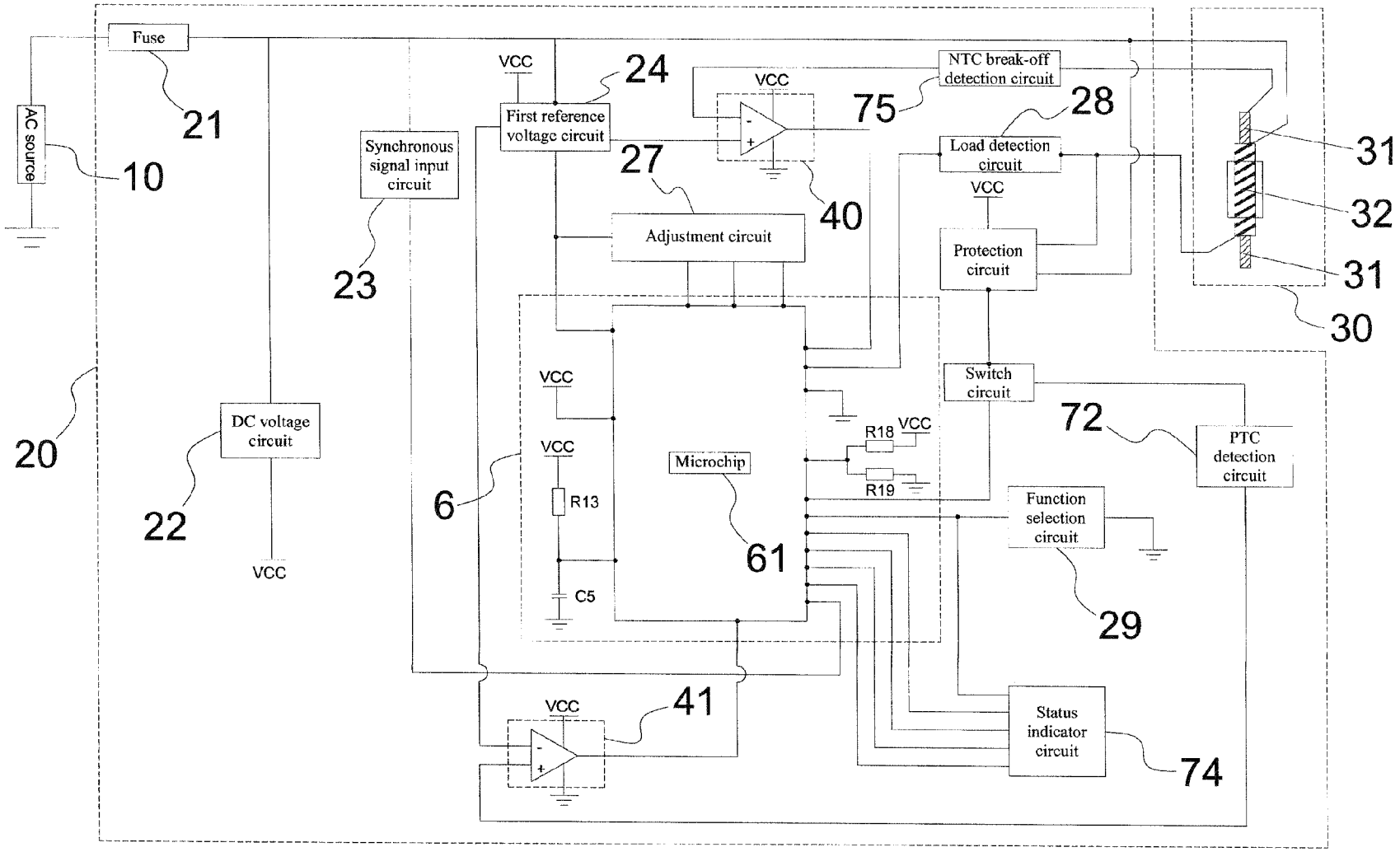
PRIOR ART FIG.1
FIG. 1 is a functional block diagram of a conventional dual-core heating cable control device.
Figure 2:
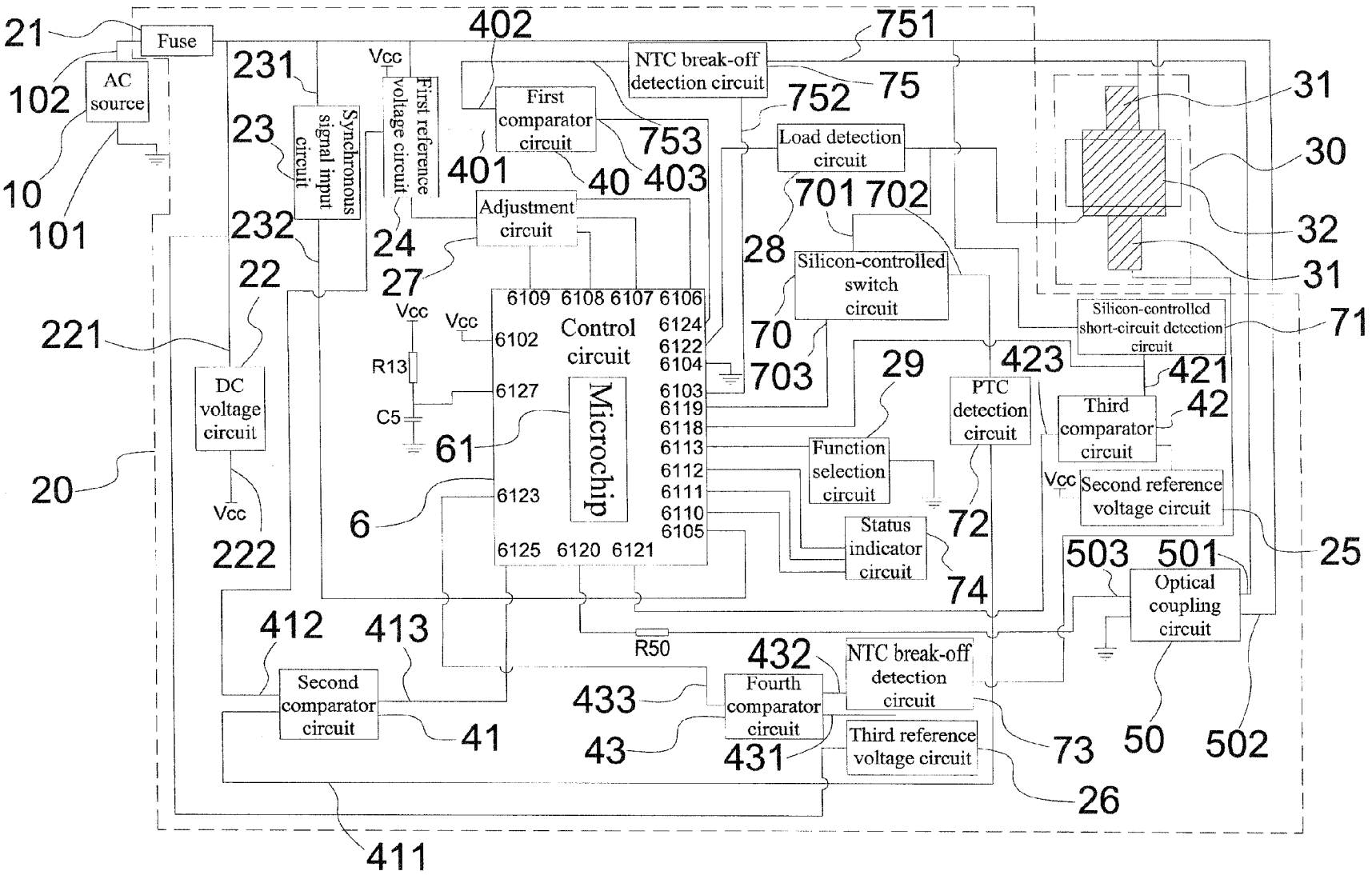
FIG. 2 is a functional block diagram of a dual-core heating cable control system of the present invention.
Figure 3:
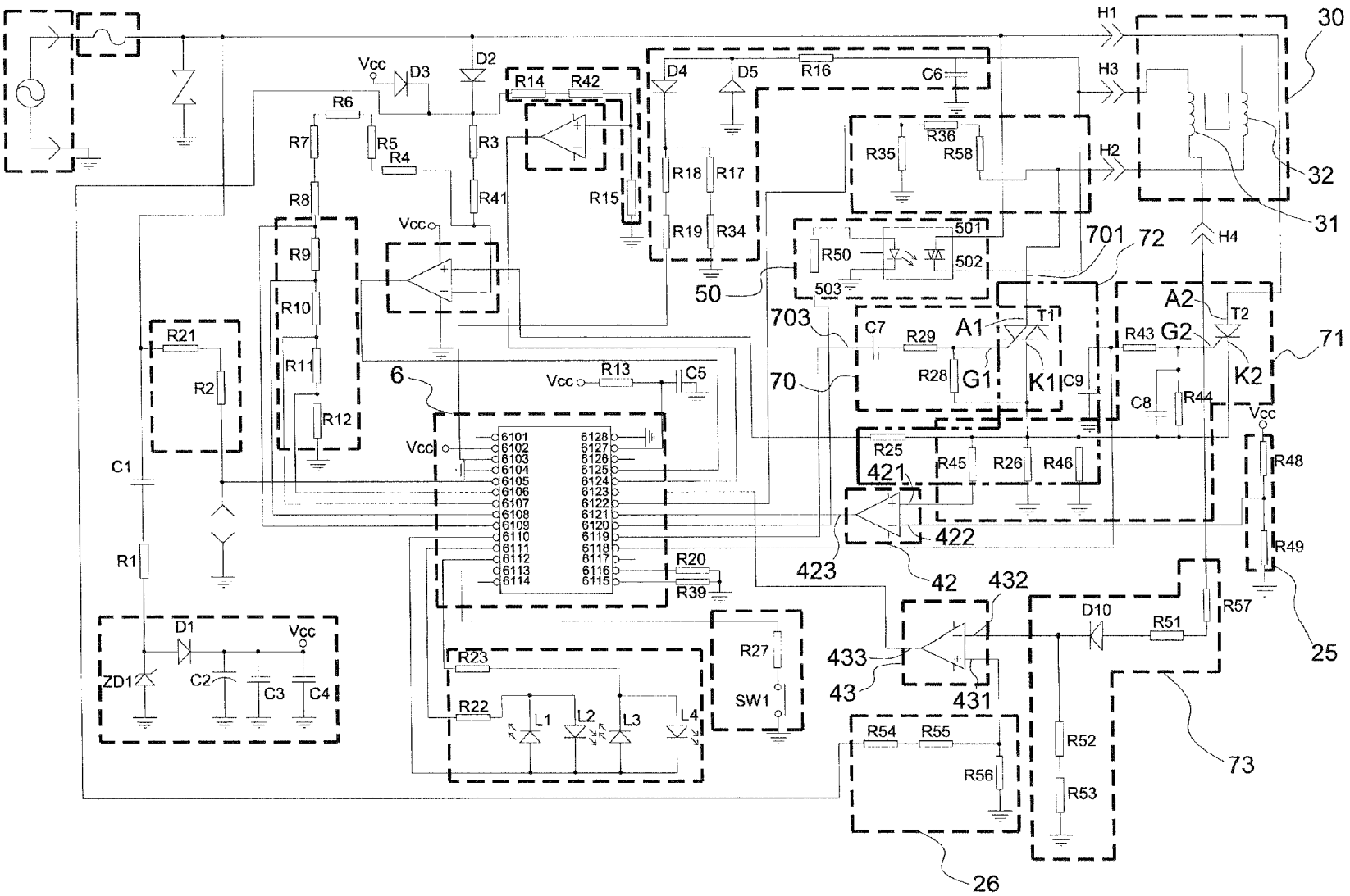
FIG. 3 is schematic circuit diagram of the dual-core heating cable control system of the present invention.
Figures 1, 3:
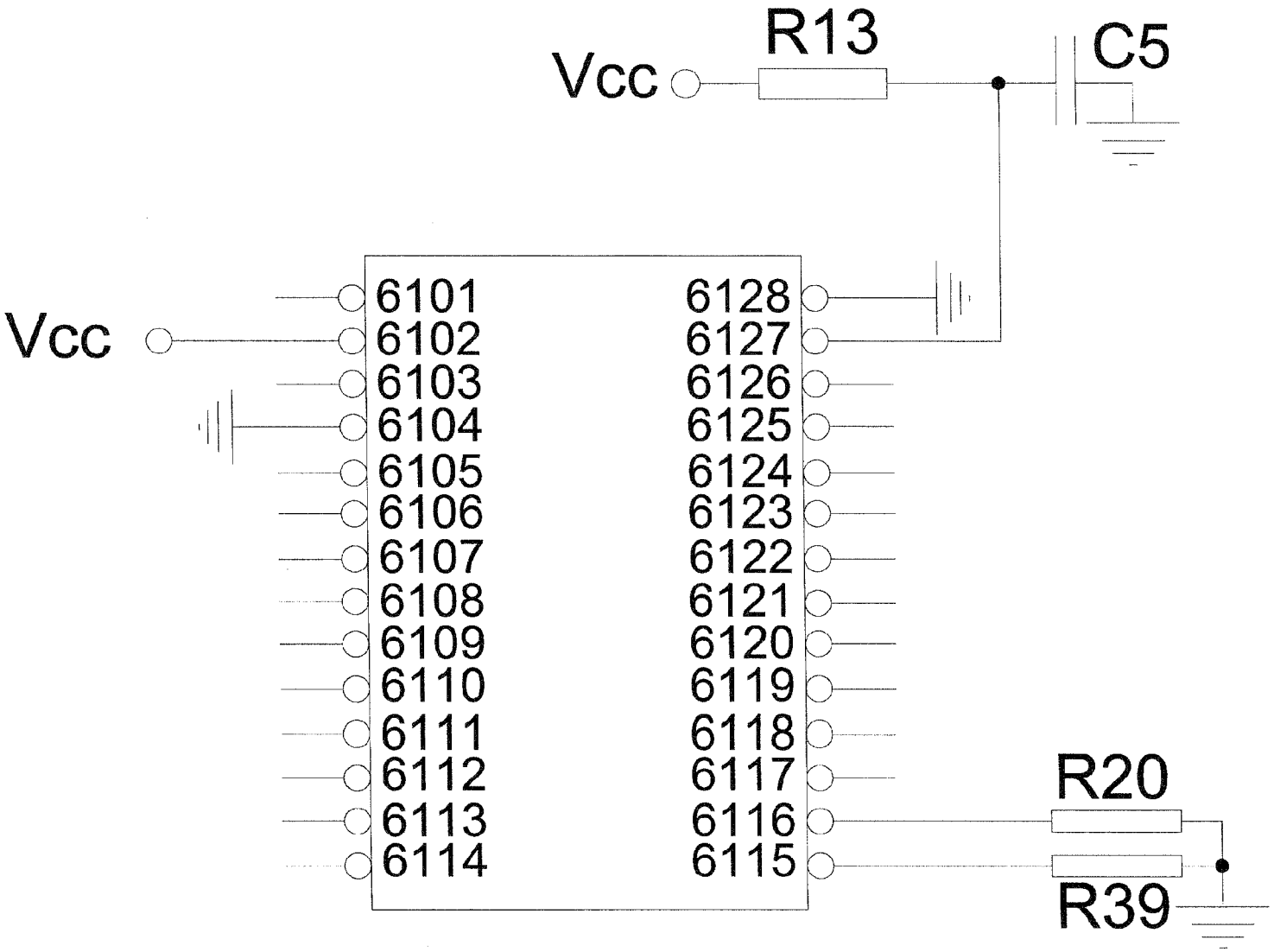

As shown in FIGS. 2 and 3, a heating cable control system according to an embodiment of the present invention mainly contains a control device and a dual-core heating cable 30. The control device contains a fuse 21, a DC voltage circuit 22, a synchronous signal input circuit 23, a first reference voltage circuit 24, a control circuit 6, a NTC detection circuit 75, an adjustment, circuit 27, a load detection circuit 28, a silicon controlled switch circuit 70, a silicon controlled short-circuit detection circuit 71, a function selection circuit 29, a PTC detection circuit 72, a second reference voltage circuit 25, a NTC break-off detection circuit 73, a third reference voltage circuit 26, a status indicator circuit 74, an optical coupling circuit 50, a first comparator circuit 40, a second comparator circuit 41, a third comparator circuit 42, and a fourth comparator circuit 43. Please also refer to FIG. 3-1, the control circuit 6 contains a microchip 61 having a first pin 6101, a second pin 6102, a third pin 6103, a fourth pin 6104, a fifth pin 6105, a sixth pin 6106, a seventh pin 6107, an eighth pin 6108, a ninth pin 6109, a tenth pin 6110, an eleventh pin 6111, a twelfth pin 6112, a thirteenth pin 6113, a fourteenth pin 6114, a fifteenth pin 6115, a sixteenth pin 6116, a seventeenth pin 6117, an eighteenth pin 6118, a nineteenth pin 6119, a twentieth pin 6120, a twenty first pin 6121, a twenty second pin 6122, a twenty third pin 6123, a twenty fourth pin 6124, a twenty fifth pin 6125, a twenty sixth pin 6126, a twenty seventh pin 6127, and a twenty eighth pin 6128. The second pin 6102 is electrically connected to a second terminal 222 of the DC voltage circuit 22. The third pin 6103 is electrically connected to a second terminal 752 of the NTC detection circuit 75. A first terminal 751 of the NTC detection circuit 75 is electrically connected to a first terminal H3 of a NTC resistive layer 31 of the dual-core heating cable 30. A third terminal 753 of the NTC detection circuit 75 is electrically connected to a negative input terminal 402 of the first comparator circuit 40. The fourth pin 6104 is connected to ground. The fifth pin 6105 is electrically connected to a second terminal 232 of the synchronous signal input circuit 23. A first terminal 231 of synchronous signal input circuit 23 is electrically connected to a first terminal 221 of the DC voltage circuit 22. The sixth, seventh, eighth, and ninth pins 6106, 6107, 6108, and 6109 are electrically connected to an terminal of the adjustment circuit 27, respectively, and another terminal of the adjustment circuit 27 is electrically connected the first reference voltage circuit 24. The tenth, eleventh, and twelfth pins 6110, 6111, and 6112 are electrically connected to the status indicator circuit 74, respectively. The thirteenth pin 6113 is electrically connected to a terminal of the function selection circuit 29 whose another terminal is connected to ground. The fifteenth pin 6115 is configured with a thirty ninth resistor R39 whose one terminal is connected to the fifteenth pin 6115 and another terminal is connected to ground. The sixteenth pin 6116 is configured with a twentieth resistor R20 whose one terminal is connected to the sixteenth pin 6116 and another terminal is connected to ground and the thirty ninth resistor R39's another terminal. The eighteenth pin 6118 is electrically connected to a terminal of the silicon-controlled short-circuit detection circuit 71. The nineteenth pin 6119 is electrically connected to a third terminal 703 of the silicon-controlled switch circuit 70. A first terminal 701 of the silicon-controlled switch circuit 70 is electrically connected to the load detection circuit 28's another terminal. A second terminal 702 of the silicon-controlled switch circuit 70 is electrically connected to a terminal of the PTC detection circuit 72. The twentieth pin 6120 is electrically connected to an input terminal 503 of the optical coupling circuit 50 further having a first control terminal 501 and a second control terminal 502. The twenty-first pin 6121 is electrically connected to an output terminal 423 of the third comparator circuit 42. A negative input terminal 422 of the third comparator circuit 42 is electrically connected to the second reference voltage circuit 25. A positive input terminal 421 of the third comparator circuit 42 is electrically connected to the silicon-controlled short-circuit detection circuit 71. The twenty-second pin 6122 is electrically connected to a terminal of the load detection circuit 28. Another terminal of the load detection circuit 28 is electrically connected to a second terminal H2 of a PTC resistive wire 32, and the first terminal 701 of the silicon-controlled switch circuit 70. The twenty third pin 6123 is electrically connected to an output terminal 433 of the fourth comparator circuit 43 whose positive and negative input terminals 431 and 432 are electrically connected to the third reference voltage circuit 26 and the NTC break-off detection circuit 73, respectively. The twenty fourth pin 6124 is electrically connected to an output terminal 403 of the first comparator circuit 40 whose positive and negative input terminals 401 and 402 are electrically connected to the first reference voltage circuit 24 and the third terminal 753 of the NTC detection circuit 75, respectively. The twenty fifth pin 6125 is electrically connected to an output terminal 413 of the second comparator circuit 42 whose positive and negative terminals 411 and 412 are electrically connected to the PTC detection circuit 72 and the first reference voltage circuit, respectively. The twenty seventh pin 6127 is configured with a thirteenth resistor R13 whose one terminal is connected to the DC voltage $V_{cc}$ and another terminal is connected to the twenty seventh pin 6127. The twenty seventh pin 6127 is also configured with a fifth capacitor C5 whose one terminal is connected to the thirteenth resistor R13's another terminal, and whose another terminal is connected to the twenty seventh pin 6127.

The dual-core heating cable 30 contains the NTC resistive layer 31 and the PTC resistive wire 32 inside. The PTC resistive wire 32 has a first terminal H1 and the second terminal H2. The NTC resistive layer 31 has the first terminal H3 and a second terminal H4. The first terminals H1 and H3 of the PTC resistive wire 32 and the NTC resistive layer 31 are electrically connected to the first and second control terminals 501 and 502 of the optical coupling circuit 50, respectively. The first control terminal 501 is also electrically connected to AC voltage. The second terminals H2 and H4 of the PTC resistive wire 32 and the NTC resistive layer 31 are electrically connected to the load detection circuit 28's another terminal and a terminal of the NTC break-off detection circuit 73, respectively.

Figure 4:
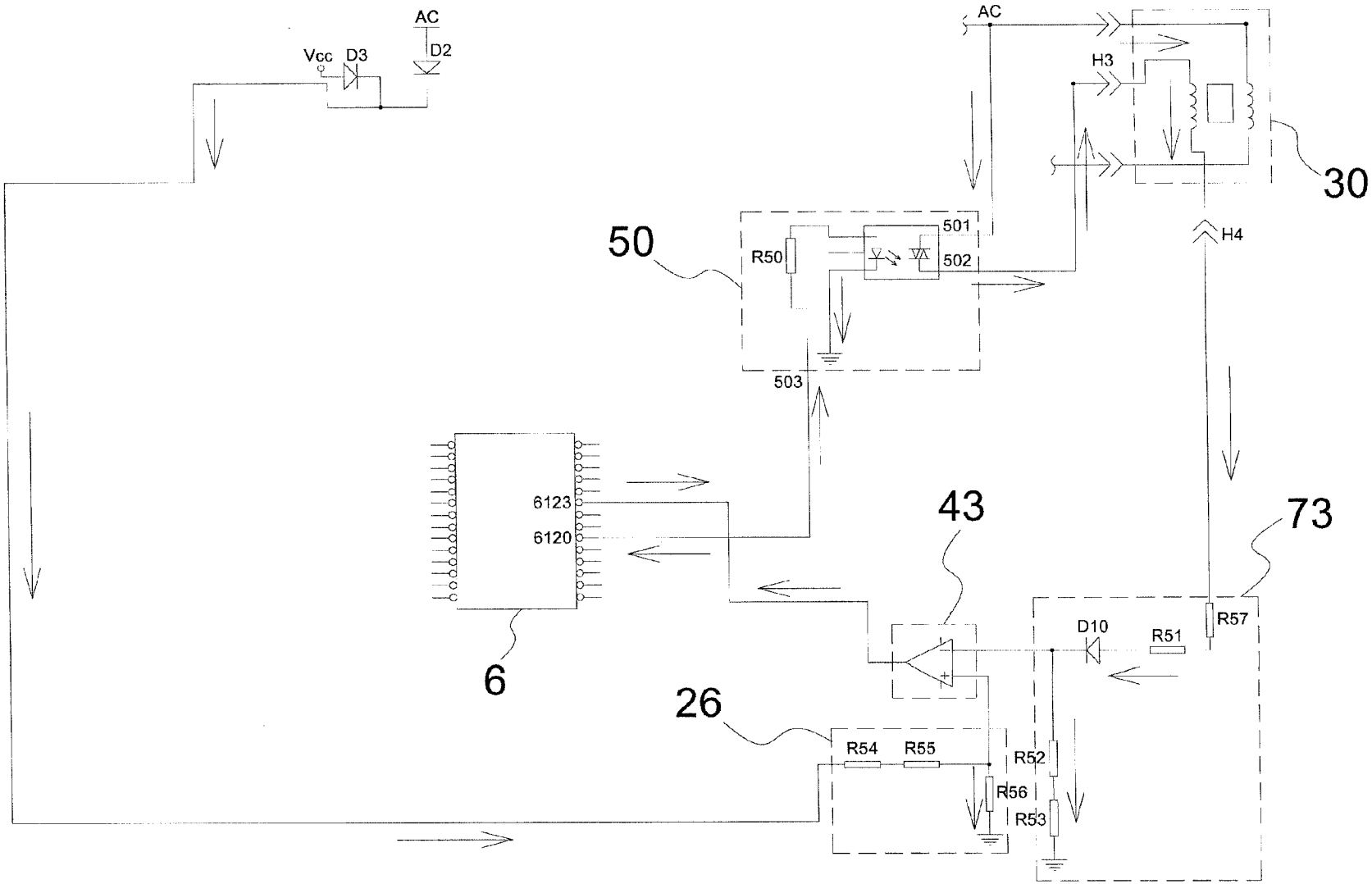
FIG. 4 is a schematic diagram showing the detection of the NTC resistive layer of the dual-core heating cable control system of the present invention.
Figures 1, 4:
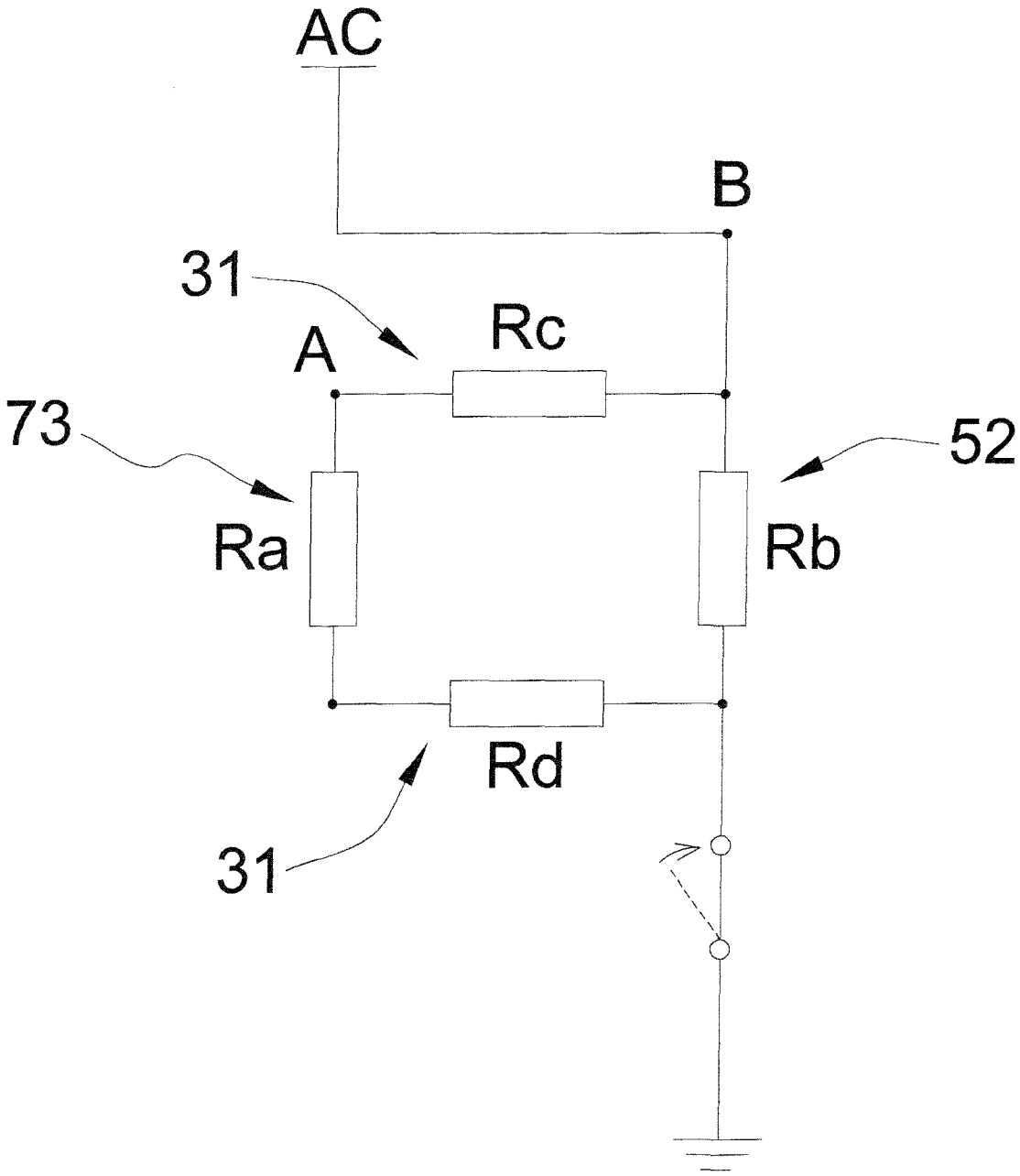

As shown in FIG. 3, the optical coupling circuit 50 of the present invention has the input terminal 503, the first control terminal 501, and the second control terminal 502. The first and second control terminals 501 and 502 are electrically connected to the first terminals H3 and H1 of the NTC resistive layer 31 and the PTC resistive wire 32, respectively. As also shown in FIGS. 4 and 4-1, when the PTC resistive wire 32 is to be heated up, the switch SW1 is closed and AC voltage is conducted through the PTC resistive wire 32 to ground. The PTC resistive wire 32 has resistance $R_b$ and the NTC break-off detection circuit 73 has resistance $R_a$ where both $R_a$ and $R_b$ are 100Ω. The NTC resistive layer 31 has resistances $R_c$, $R_d$ which are both 800KΩ. Then, the voltage between the points A and B (i.e., the voltage between the PTC resistive wire 32 and the NTC resistive layer 31) can be obtained from the following equation where $R_a$ is ignored as it is relatively small compared to $R_c$ and $R_d$:

$$V_{ab} = V_{AC} * \frac{R_c}{Ra + Rc + Rd} = V_{AC} * \frac{800\text{ K}}{100 + 800\text{ K} + 800\text{ K}} = V_{AC} * \frac{800\text{ K}}{800\text{ K} + 800\text{ K}} = \frac{V_{AC}}{2}$$

Figure 5:
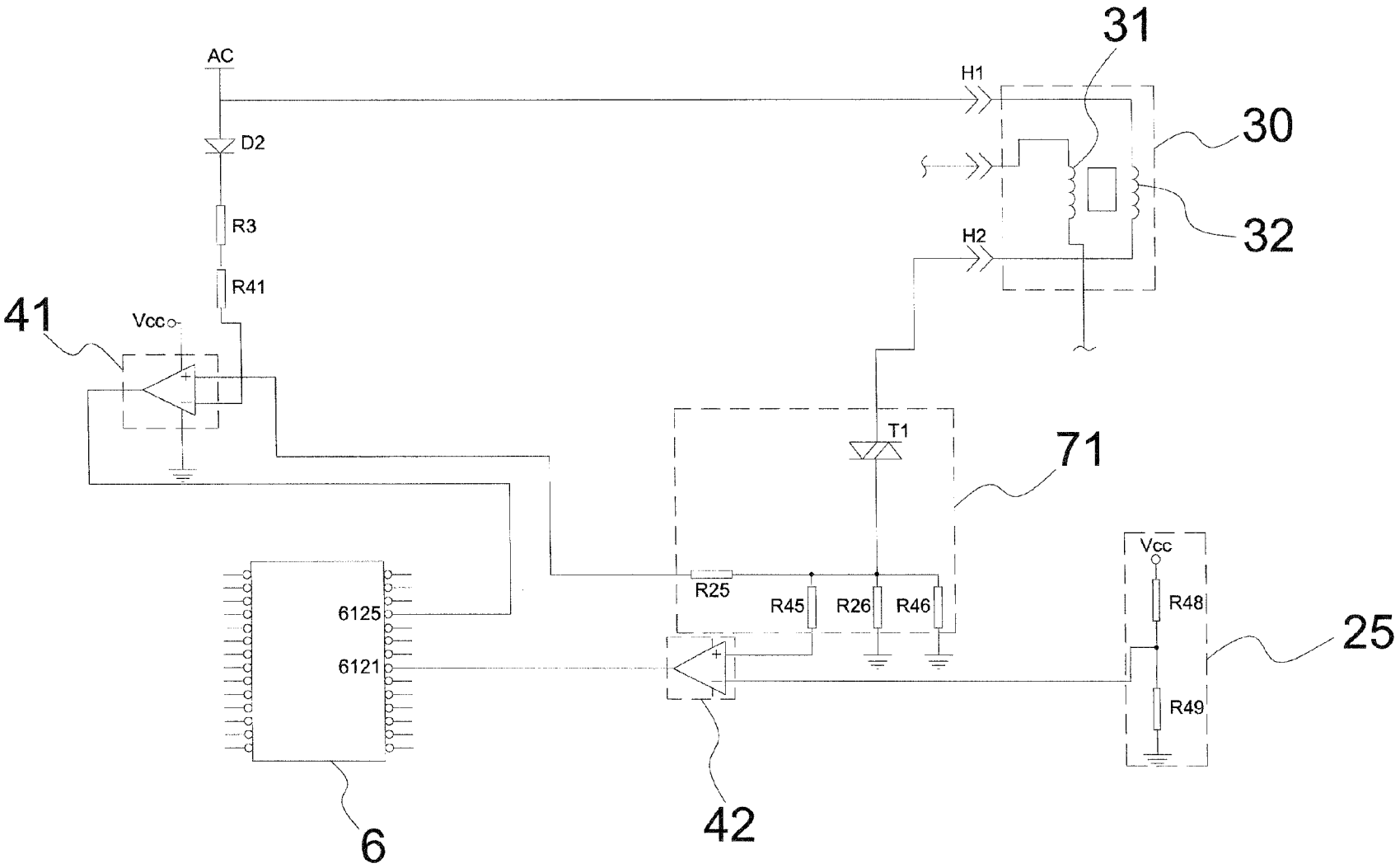
FIG. 5 is a schematic diagram showing the heating up of the PTC resistive wire of the dual-core heating cable control system of the present invention.

The voltage between the NTC resistive layer 31 and the PTC resistive wire 32 is one half of the source voltage. Then, by electrically connecting the second terminal H4 of the NTC resistive layer 31 to the NTC break-off detection circuit 73, a terminal of the NTC break-off detection circuit 73 to the negative input terminal 432 of the fourth comparator circuit 43, the positive input terminal 431 of the fourth comparator circuit 43 to the third reference voltage circuit 26, and the third reference voltage circuit 26 to the DC voltage $V_{cc}$, the fourth comparator circuit 43 produces a comparison result between its positive and negative input terminals 431 and 432 when the PTC resistive wire 32 is heated up, as shown in FIG. 5. By electrically connecting the first and second control terminals 501 and 502 of the optical coupling circuit 50 to the first terminals H3 and H1 of the NTC resistive layer 31 and the PTC resistive wire 32, the voltage between the NTC resistive layer 31 and the PTC resistive wire 32 could be comparable to the AC voltage. As the second terminal H4 of the NTC resistive layer 31, through the NTC break-off detection circuit 73, is compared against the third reference voltage circuit 26 by the fourth comparator circuit 43, the comparison result (i.e., a high- or low-level signal) is delivered to the microchip 61 of the control circuit 6 for examination through the output terminal 433 of the fourth comparator circuit 43. If the comparison result is a high-level signal, the NTC resistive layer 31 or the NTC detection circuit 75 is considered as not breaking off. The microchip 61 of the control circuit 6 issues signals to the optical coupling circuit 50 to conduct the first and second control terminals 501 and 502, so that the PTC resistive wire 32 is continuously heated up. On the other hand, as shown in FIG. 3, if the comparison result is a low-level signal, the NTC resistive layer 31 or the NTC detection circuit 75 is considered as breaking off. The microchip 61 of the control circuit 6 turns off the silicon-controlled switch circuit 70 and the PTC resistive wire 32, so that the PTC resistive wire 32 is stopped from heating up. Therefore, both user and operation safety is enhanced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A heating cable control system, comprising an AC source, a control device and a dual-core heating cable, wherein the dual-core heating cable comprises a negative temperature coefficient (NTC) resistive layer and a positive temperature coefficient (PTC) resistive wire, the PTC resistive wire has a first terminal and a second terminal, and the NTC resistive layer has a first terminal and a second terminal;

the control device comprises an optical coupling circuit, a reference voltage circuit, a comparator circuit, a NTC detection circuit, a NTC break-off detection circuit, a silicon controlled switch circuit, and a control circuit;

the first terminal of the PTC resistive wire is electrically connected to the AC source;

the second terminal of the PTC resistive wire is electrically connected to the silicon-controlled switch circuit;

the first terminal of the NTC resistive layer is electrically connected to the first terminal of the PTC resistive wire through the optical coupling circuit, and to the NTC detection circuit;

the second terminal of the NTC resistive layer is electrically connected to the NTC break-off detection circuit;

the NTC break-off detection circuit and the reference voltage circuit are electrically connected to the comparator circuit;

the control circuit is electrically connected to the silicon controlled switch circuit, the NTC detection circuit, and the comparator circuit;

When the PTC resistive wire is to be heated up, AC voltage is conducted through the PTC resistive wire and is applied to the NTC resistive layer via the optical coupling circuit;

a voltage from the NTC break-off detection circuit is compared against a reference voltage from the reference voltage circuit by the comparator circuit, and a comparison result is delivered to the control circuit; and if the comparison result indicates that the NTC resistive layer or the NTC detection circuit is open-circuited, the control circuit turns off the silicon-controlled switch circuit, so that the PTC resistive wire is stopped from heating up.

* * * * *